United States Patent [19]

Myers et al.

[11] Patent Number: 4,512,774

[45] Date of Patent: Apr. 23, 1985

[54] RESIDUAL FUEL OIL CONDITIONERS CONTAINING METAL SALTS IN AQUEOUS SOLUTION

[75] Inventors: John G. Myers, Pittsburgh; Douglas P. Logan; Jerry L. Walker, both of Coraopolis, all of Pa.

[73] Assignee: Calgon Corporation, Pittsburgh, Pa.

[21] Appl. No.: 973,783

[22] Filed: Dec. 27, 1978

[51] Int. Cl.[3] ..... C10L 1/32

[52] U.S. Cl. ..... 44/51

[58] Field of Search ..... 44/51, DIG. 3

[56] References Cited

U.S. PATENT DOCUMENTS 3,876,391 4/1975 McCoy at al. ..... 44/51

FOREIGN PATENT DOCUMENTS 976755 10/1975 Canada .

OTHER PUBLICATIONS (Japanese Patent Publication), col. 25773, 22-*Petroleum*, Item (a), publ. 1960.

*Primary Examiner*—Y. Harris-Smith

*Attorney, Agent, or Firm*—Ernest V. Linek; R. Brent Olson

[57] ABSTRACT

Residual fuel oil conditioners comprising an aqueous solution of (a) from 2.0 to 20.0% by weight of at least one water soluble metal salt selected from the halides, sulfates, and nitrates of magnesium, manganese, zinc, copper, lead, iron, nickel, aluminum, calcium and barium; and (b) from 0.1 to 25.0% by weight of a surfactant, preferably a nonionic surfactant having an HLB of from 12 to 17.

13 Claims, No Drawings

RESIDUAL FUEL OIL CONDITIONERS CONTAINING METAL SALTS IN AQUEOUS SOLUTION

BACKGROUND OF THE INVENTION

1. Field of the Invention

The present invention relates to residual fuel oil conditioners and their use in improving combustion and preventing, inhibiting or removing combustion deposits and corrosion resulting from the burning of residual fuel oils.

Residual fuel oils, such as No. 5 and No. 6 fuel oils, are one of the major fuels used in firing large industrial and institutional boilers. Residual oils are derived from various crudes, for example naphthenic, paraffinic, and Mid-Continent crudes, and they have boiling ranges above 850° F., are liquid at room temperature, and have API gravities of about 1 to 15 or more. The residual oils are attractive economically, being cheaper than other oils, but they pose a serious problem: they contain a higher proportion of various inorganic elements and compounds which result in unwanted deposits and corrosion when the residual fuel oil is burned.

Deposits resulting from combustion of residual fuel oils, referred to as fireside deposits, for example slag, are the result of inorganic contaminants in the fuel. In the high temperature zone of the typical boiler system, for example the waterwalls, screen tubes, superheaters and convection risers, such fireside deposits create a serious problem, ultimately resulting in an unacceptable lowering of heat transfer efficiency.

A particular problem created by combustion of residual fuel oils arises from the concentration of vanadium compounds in such oils. Vanadium not only forms a part of the ash and slag of the fireside deposits, with attendant reduction in operating efficiency of the boiler system, but the vanadium-containing ash deposits also present a serious problem of corrosion.

Upon combustion, complex organic compounds of vanadium, sodium, and sulfur form low melting ash or slag deposits on the firebox, superheater and reheater tubes, supports, hangers, and spacers of a typical boiler. The actual location of ash or slag build-up depends upon the particular boiler design, and the amount of fouling is a function of the oil composition. For example, fuel oils having low sulfur and low vanadium content cause very little fouling, in the high temperature zone, while extensive fouling occurs when the sulfur content is from 2.3% to 3% and the vanadium content is from 300 to 500 parts per million. Since the oxides of vanadium have relatively low melting points, the ash derived from these oxides may be in a plastic state while being carried in the hot combustion gases. When this ash strikes the cooler metallic surfaces of the components of the fuel burning equipment, it adheres tightly. The deposits thus created insulate the metallic surfaces, impede heat transfer and raise the temperature of the outer metallic component surface. Moreover, this condition tends to trap additional ash which might not adhere under normal circumstances to clean metallic surfaces. As gas passages thus become smaller, the velocity, and hence the impingement force of the gases and ash particles increases, and the fouling rate is thereby accelerated. Because of this resultant heat barrier, output of the fuel burning equipment, for example a boiler, can be maintained only at the expense of increased energy input requiring consumption of additional fuel. The result is a less efficient and, consequently, more expensive operation of the fuel burning equipment. Moreover, removal of these slag deposits is very difficult due to their extreme hardness and tight adherence to the metallic surfaces of the fuel burning equipment; and the nature of the equipment itself, particularly modern boilers, makes many parts thereof inaccessible to cleaning.

The oxides of vanadium which produce slag deposits as described above, have also been found to be highly corrosive to metals. For example, vanadium pentoxide and sodium sulfate, both of which are formed during the combustion of residual fuel oils, react to form the most corrosive vanadium slag, $\beta$-sodium vanadyl vanadate, in accordance with the following reaction:

$$6V_2O_5 + Na_2SO_4 \xrightarrow{\Delta} SO_3\uparrow + Na_2O.V_2O_4.5V_2O_5$$

At 850° C. this vanadate is a reddish colored corrosive liquid which can adsorb oxygen, and when it solidifies it releases this adsorbed oxygen. The resulting slag is a very hard, blackish colored material. Another vanadium slag commonly found in fuel burning equipment such as boilers is sodium vanadate, $Na_2O.2V_2O_5$. However, the present invention is applicable to the problem of corrosion and slag deposits caused by all compositions formed from vanadium, vanadium and sodium, and sulfur, as well as other inorganic and metallo-organic compounds, during combustion of residual fuel oils.

Theories as to the precise mechanism of corrosive attack by vanadium oxide slags on steels vary. The vanadium oxide slags are characterized by low melting points and they are capable, in that state, of dissolving or absorbing oxygen which is then transferred to the metallic surfaces of the fuel burning equipment, ultimately resulting in oxidation, and thus corrosion, of the metal component. An alternative, or concomitant, mode of corrosive attack on steel surfaces by vanadium oxide slags is found in their continuous removal of the normally protective oxide layer from the surface of the steel component.

Unfortunately, the inorganic contaminants in residual fuel oils which create the problems described above are present in such small quantities and their chemical makeup is such that methods for their removal from residual oils are difficult to apply economically on a commercial scale.

Yet another problem created by combustion of residual fuel oils occurs in the cold-end zone of the typical boiler system, for example the economizer tubes, air heaters, fans and stacks, where sulfur trioxide formation and sulfuric acid condensation cause serious corrosion problems. It is generally considered that vanadium oxide deposits effectively catalyze the oxidation of sulfur dioxide contained in the waste gas from typical residual fuel oil burning. The resulting sulfur trioxide combines with water vapor also typically present to form sulfuric acid. This sulfuric acid, upon condensation, can be a source of corrosive attack on the steel components of burning equipment, particularly those portions of such equipment located somewhat downstream from the site of burning. The present invention is useful in preventing corrosive attack upon the steel components of burning equipment by condensed sulfuric acid resulting from reaction of sulfur trioxide and water vapor. The metals of the present invention are multi-functional in their ability to reduce sulfuric acid corrosion and acid-induced deposition in the cold temperature zone. The metals reduce the iron oxide surface which causes catalytic formation of sulfur trioxide, by forming a protective shield over the iron oxide. Further, the combustion improvement capabilities of the metals of the present invention reduce the concentration of unburned carbon, whereby it is thus removed from the sticky sulfuric acid/unburned carbon system. In this particular additional aspect of the present invention, the metal salt aqueous solution conditioners of the present invention, when utilized in the operation of fuel burning equipment, form a protective coating or deposit upon the surfaces of the steel components of the fuel burning equipment, thereby insulating such surfaces from attack by the condensed sulfuric acid. Such corrosive attack by condensed sulfuric acid is most likely to occur in the lower temperature portions of the fuel burning equipment downstream from the site of burning. Thus, the present invention is also effective in preventing corrosion of the steel components of fuel burning equipment caused by sulfur compounds contained in residual fuel oil burned therein. Whether these modes of corrosive attack are found to be operating together, or individually, or whether some other theoretical or proven mode of corrosive attack is considered to be operating, the present invention is not limited thereto, but rather is limited only as claimed herein.

All of the problems described above can be prevented or rendered less serious by the addition to the residual fuel oil, of small amounts of any one or a combination of such metals as magnesium, manganese, zinc, copper, lead, iron, nickel, aluminum, calcium and barium. The different metals contribute in different ways, extents, and degrees to preventing, decreasing, or removing the various deposit and corrosion problems described above, as is known in the art. Thus, the art has focused on different techniques for introducing the metals for treating residual fuel oils into those oils.

2. Brief Description of the Prior Art

Heretofore, basically three approaches have been taken to the problem of how to introduce small amounts of metals or metal salts into residual oils and maintain them in a dispersed state therein for the purpose or preventing, inhibiting or removing deposits and corrosion when the residual oil is burned. First, organic soluble solutions of the metals have been prepared using metalloorganic compounds. While these solutions are easily added to residual fuel oils and are readily maintained in a dispersed state therein, their cost is unacceptably high. Second, oil suspensions of various metal oxides have been prepared, but these are added to the pressurized, heated oil just prior to atomization of the fuel. While these products are relatively inexpensive, they are difficult to feed to the residual oil, and they experience settling on storage. Third, water-in-oil emulsions of various water soluble metal salts have been used for treating residual oils. While these products are cost effective and easy to use, they often experience problems with phase separation. Unlike these approaches of the past, the present invention provides a novel and more efficient residual fuel oil conditioner based on an aqueous solution of the treating metal salts.

The following are referred to for a more detailed description of the deposit and corrosion problems discussed above, as well as some of the solutions which have been explored in the past: U.S. Pat. Nos. 2,845,338; 3,000,710; Canadian Patent No. 967,755; and Japanese Patent Publication No. 12,083 (1960).

SUMMARY OF THE INVENTION

In accordance with the present invention there are provided residual fuel oil conditioners comprising an aqueous solution of (a) from 2.0 to 20.0% by weight of at least one water soluble metal salt selected from the halides, sulfates, and nitrates of magnesium, manganese, zinc, copper, lead, iron, nickel, aluminum, calcium and barium; and (b) from 0.1 to 25.0% by weight of a surfactant, preferably a nonionic surfactant having an HLB of from 12 to 17.

The present invention also provides methods for treating residual fuel oils with conditioners, whereby combustion is improved and deposits and corrosion ordinarily resulting from the combustion of such fuel oils are prevented, inhibited or removed.

In a preferred aspect of the present invention, the water soluble metal salts are selected from magnesium chloride and manganese chloride and the nonionic surfactant has an HLB of from 13 to 16, preferably 15 to 16.

In a most preferred aspect of the present invention, conditioner solutions containing (a) 15.0% by weight of manganese as metal, or (b) 6.7% by weight of magnesium as metal, or (c) 4.7% by weight each of both magnesium and manganese as metal, and 10.0% by weight of LONZESI SMP 20 surfactant for each of the above, are provided.

The use of the proper surfactant is an essential requirement for the conditioner solutions of the present invention. The surfactant may be an anionic surfactant or a nonionic surfactant. Suitable anionic surfactants include free acids of complex organic phosphate esters, for example, GAFAC RS 610 from GAF, and DEXTROL OC-15, from Dexter Chemical Corp.; complex organic polyphosphoric esters, acids, and anhydrides, for example, STRODEX SE 100, from Dexter Chemical Corp.; and potassium salts of complex organic phosphates, for example STRODEX V-8, from Dexter Chemical Corp.

Suitable nonionic surfactants are those having an HLB of from 12 to 17, preferably 13 to 16, most preferably 15 to 16. HLB refers to hydrophilic/lipophilic balance and the HLB number correlates roughly with the solubility of the particular surfactant in water.

Suitable nonionic surfactants include, for example, condensation products of alkyl phenols with ethylene oxide, and ethylene oxide condensation products of polyhydric alcohol partial higher fatty esters. Following is a table of preferred nonionic surfactants, together with their manufacturers, trade designations, chemical compositions, and HLB numbers:

| Trade Designation | Manufacturer | Chemical Composition | HLB No. |
|---|---|---|---|
| LONZEST SMP 20 | Lonza | polyoxyethylene(20) sorbitan monopalmitate | 15.6 |
| TWEEN 80 | ICI | polyoxyethylene(20) sorbitan mono-oleate | 15.0 |
| TWEEN 40 | ICI | polyoxyethylene(20) sorbitan monopalmitate | 15.6 |
| TWEEN 20 | ICI | polyoxyethylene(20) sorbitan monolaurate | 16.7 |

-continued

| Trade Designation | Manufacturer | Chemical Composition | HLB No. |
|---|---|---|---|
| EMULPHOR EL 620 | GAF | polyoxyethlated vegetable oil | 12.0-13.0 |
| IGEPAL DM 530 | GAF | dialkylphenoxypoly (ethyleneoxy)ethanol | 10.6 |
| B6-02 | Baroid | oxyethylated | 12.9 |
| AKTAFLO-E | Petroleum Serv. Div., NL Industries | alkyl phenols | |

The metal salt aqueous solution conditioners of the present invention are readily prepared by simple mixture of the selected components. The water soluble metal salts selected from the halides, sulfates, and nitrates of magnesium, manganese, zinc, copper, lead, iron, nickel, aluminum, calcium and barium are added in an amount of from 2.0 to 20.% by weight of the total conditioner solution. The amount of metal salt employed will vary with the particular metal and salt chosen, with the surfactant selected, with the particular residual oil and fuel burning equipment being treated, and will depend upon whether or not two or more metal salts are utilized together in one aqueous solution conditioner.

The surfactant which is selected is added in an amount of from 0.1 to 25% by weight of the total conditioner solution, preferably in an amount of from 2.0 to 15.0%, and most preferably from 8.0 to 12.0% by weight of the total conditioner solution.

It is an advantage of the aqueous solution residual fuel oil conditioners of the present invention that they permit relatively high concentrations of the metal salts in aqueous solution, and yet afford good stability in use. The economic benefits attendant the use of products with relatively high concentrations of active ingredients is well recognized.

The residual fuel oil conditioners of the present invention are characterized by improved stability, and will often prove stable at temperatures ranging from −12° F. to 180° F. for periods of as long as thirty days. Moreover, the conditioners of the present invention are also easily introduced and dispersed into the residual fuel oil.

The residual fuel oil conditioners of the present invention may be introduced into the residual fuel oil at several points in feeding systems typical of those employed with large industrial and institutional boiler systems. For example, the conditioner solution is most preferably introduced into the residual oil feed line just before it reaches the burner unit. This may be accomplished by employing, in sequence, storage means for the residual fuel oil conditioner solution, a line connecting the storage means and the fuel line carrying residual oil to the burner unit, and in that connecting line, impeller means, impeller calibration means, a pressure guage, and a check valve. The connecting line enters the residual oil fuel line, and at the center of the latter, ends in a dispensing tip.

The residual fuel oil conditioners may also be introduced into the residual fuel oil at the point in the system where the residual fuel oil is withdrawn from its storage tank and impelled through a line leading ultimately to the burner unit, but usually first going through a preheater, and sometimes a day storage tank. The residual fuel oil conditioner may also be introduced into the line through which the residual fuel oil is impelled into its storage tank.

Introduction of the aqueous solution conditioner into the residual fuel oil may be either continuous or intermittent. The dosage level for the conditioner will depend upon the makeup of the conditioner solution itself, as well as upon the particular type and severity of corrosion or deposit problem being treated. Generally, it is desired to maintain a treatment level of from 25 to 100 parts-per-million (ppm) of the active metal, based on total residual oil in the system, although treatment levels as high as 1000 ppm and as low as 5 ppm have been employed.

The aqueous solution conditioners of the present invention are useful in substantially reducing and preventing corrosion and slag deposition on steel components of fuel burning equipment resulting from sodium, vanadium, sulfur, and other compounds contained in residual fuel oil burned therein, at temperatures generally in the range of from 150° to 1000° C., and more particularly in the range of from 150° to 850° C. The particular metallurgical composition of the steels forming the components of burning equipment to which the present invention is applicable may vary considerably. Such steels include common steels and stainless steels such as ferrite stainless and austenitic stainless steels. The austentic stainless steels have been found particularly useful for forming the primary components of high temperature burning equipment such as modern boilers. Austentic stainless steels may be defined as alloy steels containing approximately 18% chromium, 8% nickel, and from 1 to 4% molybdenum. The types of fuel burning equipment with which the aqueous solution conditioners of the present invention may be utilized to substantially reduce and prevent corrosion and slag deposition include, for example, oil fired boilers, furnances, diesel engines and gas turbines.

The present invention will be better understood through the following examples, which are presented by way of illustration thereof only.

EXAMPLE 1

A number of test samples were prepared using 4.5 ml. of an aqueous manganese chloride solution of 18.8% by weight concentration of manganese, and 0.77 ml. of various selected surfactants for each sample. The samples are added to No. 6 residual oil in amounts sufficient to give a 100 ppm concentration of manganese in the residual oil. The following test procedure was employed:

1. Five gallons of No. 6 residual oil were mixed together.
2. 450 g. aliquots of the residual oil were poured into one-quart jars (total: 38).
3. The jars were placed in an oil bath at 180° F.
4. The test samples were added to the jars of residual oil in amounts sufficient to give a 100 ppm concentration of the manganese in the oil.
5. The jars were shaken by hand with an up and down motion 100 times.
6. The jars were placed in an oil bath at 180° F. for 24 hours.
7. 6 ml. of the oil in each jar were pipeted from the center of the jar, 1.5 inches below the surface, and transferred to a platinum crucible which had been weighed.

8. The contents, after weighing, were burned off to an ash, after which acid was added and an atomic absorption assay run on the ash.
9. The total data was used to calculate the concentration (in ppm) of manganese in the No. 6 residual oil after 24 hours at 180° F., the original concentration having been 100 ppm.

The results of the evaluations are set out in the table below, together with identification of the particular surfactant employed with each test sample.

| Sample No. | Surfactant | Final Concentration of Manganese (ppm) |
|---|---|---|
| 1 | LONZEST SMP 20 | 104 |
| 2 | TWEEN 80 | 102 |
| 3 | EMULPHOR EL 620 | 67 |
| 4 | DEXTROL OC-15 | 55 |
| 5 | STRODEX SE-100 | 53 |
| 6 | B6-02 AKTAFLO-E | 48 |
| 7 | IGEPAL DM 530 | 36 |
| 8 | GAFAC RS 610 | 34 |
| 9 | Blank (no surfactant) | 24 |

EXAMPLE 2

Test samples were prepared using 9.0 g. of aqueous manganese chloride solution and 1.0 g. of surfactant to give a 15.12% by weight concentration of manganese and a 10% by weight concentration of surfactant. The test samples were then added to No. 6 residual oil in amounts sufficient to give a 100 ppm concentration of manganese in the oil, and these oil samples were maintained at −12° F. for 12 days. The results of this stability study are set out in the following table of data:

| Surfactant | Condition after 12 days at −12° F. |
|---|---|
| LONZEST SMP 20 | Excellent (clear) |
| EMULPHOR EL 620 | Excellent (clear) |
| TWEEN 40 | Excellent (clear) |
| TWEEN 20 | Excellent (clear) |
| Blank (15.12% manganese, no surfactant) | Trace of $Mn_2O_3$ on bottom |

EXAMPLE 3

A long term stability study was carried out in which test samples having 15.12% by weight of manganese as chloride and 10% by weight of selected surfactants were dispersed in No. 6 residual oil at 180° F. with an initial manganese concentration in the oil of 100 ppm. Resulting concentrations after certain elapsed times were measured in accordance with the procedures of Example 1. The results of the study are set out in the table of values below:

| | Concentration (ppm) of Maganese in Supernatant | | | |
|---|---|---|---|---|
| Surfactant | 1 day | 5 days | 15 days | 30 days |
| LONZEST SMP 20 | 92 | 89 | 87 | 84 |
| TWEEN 80 | 92 | 91 | 89 | 79 |
| EMULPHOR EL 620 | 64 | 71 | 75 | 71 |
| TWEEN 40 | 99 | — | — | — |
| TWEEN 20 | 95 | — | — | — |
| Blank (no surfactant) | 16 | — | — | — |

EXAMPLE 4

The procedures of Example 1 were followed, but using zinc chloride and copper chloride solutions instead of the manganese chloride solution. The results of the evaluations are set out in the table of values below.

| | Concentration (ppm) of Metal after 24 hours at 180° F. | |
|---|---|---|
| Surfactant | Zinc | Copper |
| LONZEST SMP 20 | 81 | 73 |
| TWEEN 80 | 78 | 78 |
| EMULPHOR EL 620 | 78 | 82 |
| TWEEN 40 | 73 | 81 |
| TWEEN 20 | 78 | 80 |
| Blank (no surfactant) | 65 | 46 |

EXAMPLE 5

Test samples were prepared containing 6.7% by weight of magnesium as chloride and 10% by weight of selected surfactants. The test samples were dispersed at initial concentrations of 100 ppm in No. 6 residual oil at 180° F. and the concentrations of magnesium were measured after 24 hours and 5 days in accordance with the procedures of Example 1. The results of the evaluations are set out in the table of values below:

| | Concentration (ppm) of Magnesium | |
|---|---|---|
| Surfactant | 24 Hours | 5 Days |
| LONZEST SMP 20 | 88 | 58 |
| TWEEN 80 | 68 | 48 |
| EMULPHOR EL 620 | 58 | 46 |

EXAMPLE 6

Test samples were prepared containing 4.7% by weight of magnesium as chloride and 4.7% by weight of manganese as chloride, and 10% by weight of selected surfactants. The test samples were dispersed at initial concentrations of 100 ppm in No. 6 residual oil at 180° F. and the concentrations of magnesium and manganese were measured after 24 hours and 30 days in accordance with the procedure of Example 1. The results of the evaluations are set out in the table of values below.

| | Concentration (ppm) of Magnesium and Maganese with Time | | | |
|---|---|---|---|---|
| | Manganese | | Magnesium | |
| Surfactant | 24 Hours/ | 30 Days | 24 Hours/ | 30 Days |
| TWEEN 80 | 97 | 70 | 109 | 48 |
| EMULPHOR EL 620 | 82 | 66 | 84 | 48 |
| LONZEST SMP 20 | 101 | 72 | 115 | 54 |

EXAMPLE 7

A short term stability study was carried out in which test samples having 15.12% by weight of manganese as chloride and 10% by weight of selected surfactants were dispersed in No. 6 residual oil at room temperature, with an initial manganese concentration in the oil of 100 ppm. Resulting concentrations after one day's elapsed time were measured in accordance with the procedures of Example 1. The results of the study are set out in the table of values below.

| Surfactant | Concentration (ppm) of Magnesium in Supernatant 0 Day | 1 Day |
|---|---|---|
| LONZEST SMP 20 | 103 | 99 |
| TWEEN 80 | 103 | 91 |
| EMULPHOR EL 620 | 103 | 100 |
| TWEEN 40 | 104 | 98 |
| TWEEN 20 | 103 | 101 |
| Blank (no surfactant) | 103 | 44 |

EXAMPLE 8

A short term stability study with high concentrations was carried out in which test samples having 15.12% by weight of manganese as chloride and 10% by weight of selected surfactants were dispersed in No. 6 residual oil at 180° F. with an initial concentration in the oil of 10,000 ppm. Resulting concentrations after one day's elapsed time were measured in accordance with the procedures of Example 1. The results of the study are set out in the table of values below.

| Surfactant | Concentration (ppm) of Manganese in Supernatant 1 Day |
|---|---|
| LONZEST SMP 20 | 9310 |
| TWEEN 40 | 8990 |
| Blank (no surfactant) | 92 |

What is claimed is:

1. A residual fuel oil conditioner for improving combustion and preventing, inhibiting, or removing combustion deposits and corrosion of fuel burning equipment resulting from the burning of residual fuel oils, consisting essentially of an aqueous solution of a. from 2.0 to 20.0% by weight of at least one water soluble metal salt selected from the halides, sulfates, and nitrates of magnesium, manganese, zinc, copper, lead, iron, nickel, aluminum, calcium and barium; and b. from 0.1 to 25% by weight of a surfactant having an HLB of 12 to 17.

2. The conditioner of claim 1 wherein the metal salt is magnesium chloride.

3. The conditioner of claim 1 wherein the metal salt is manganese chloride.

4. The conditioner of claim 1 wherein the surfactant is anionic.

5. The conditioner of claim 1 wherein the surfactant is a nonionic surfactant having an HLB of from 12 to 17.

6. The conditioner of claim 5 wherein the HLB of the nonionic surfactant is from 15 to 16.

7. A residual fuel oil composition for use in fuel burning equipment comprising a major amount of residual fuel oil having distributed therethrough a conditioner for improving combustion and preventing, inhibiting, or removing combustion deposits and corrosion of fuel burning equipment resulting from the burning of said residual fuel oil, consisting essentially of an aqueous solution of a. from 2.0 to 20.0% by weight of at least one water soluble metal salt selected from the halides, sulfates, and nitrates of magnesium, manganese, zinc, copper, lead, iron, nickel, aluminum, calcium and barium; and b. from 0.1 to 25% by weight of a surfactant having an HLB of 12 to 17.

8. A method of improving combustion and preventing, inhibiting, or removing combustion deposits and corrosion of fuel burning equipment resulting from the burning of said residual fuel oils therein, comprising adding to said fuel oils prior to their use in said fuel burning equipment, a conditioner consisting essentially of an aqueous solution of a. from 2.0 to 20.0% by weight of at least one water soluble metal salt selected from the halides, sulfates, and nitrates of magnesium, manganese, zinc, copper, lead, iron, nickel, aluminum, calcium and barium; and b. from 0.1 to 25% by weight of a surfactant having an HLB of 12 to 17.

9. The method of claim 8 wherein the metal salt is magnesium chloride.

10. The method of claim 8 wherein the metal salt is manganese chloride.

11. The method of claim 8 wherein the surfactant is anionic.

12. The method of claim 8 wherein the surfactant is a nonionic surfactant having an HLB of from 12 to 17.

13. The method of claim 12 wherein the HLB of the nonionic surfactant is from 15 to 16.

* * * * *